US008029246B2

(12) United States Patent
Hanai et al.

(10) Patent No.: US 8,029,246 B2
(45) Date of Patent: Oct. 4, 2011

(54) PRESSURE-OPERATED MECHANISM AND WATER PUMP INCLUDING THE SAME

(75) Inventors: Shuichi Hanai, Toyota (JP); Kyosuke Togawa, Aichi-ken (JP); Kazunari Adachi, Chiryu (JP); Nobuhisa Nakajima, Anjo (JP); Takashi Sakumoto, Kariya (JP)

(73) Assignees: Toyota Jidosha Kabushiki Kaisha, Toyota (JP); Aisin Seiki Kabushiki Kaisha, Kariya-shi (JP)

( * ) Notice: Subject to any disclaimer, the term of this patent is extended or adjusted under 35 U.S.C. 154(b) by 673 days.

(21) Appl. No.: 12/076,420

(22) Filed: Mar. 18, 2008

(65) Prior Publication Data

US 2008/0232975 A1 Sep. 25, 2008

(30) Foreign Application Priority Data

Mar. 20, 2007 (JP) ..... 2007-073008

(51) Int. Cl.
*F04B 49/00* (2006.01)

(52) U.S. Cl. ..... 417/223; 417/420

(58) Field of Classification Search ..... 417/223, 417/316, 420; 123/41.47
See application file for complete search history.

(56) References Cited

U.S. PATENT DOCUMENTS

| | | | | |
|---|---|---|---|---|
| 2,230,717 | A * | 2/1941 | De Lancey | 417/223 |
| 3,584,974 | A * | 6/1971 | Nicastro | 417/316 |
| 5,845,625 | A * | 12/1998 | Kidokoro et al. | 123/520 |
| 7,690,335 | B2 * | 4/2010 | Togawa et al. | 123/41.47 |
| 7,922,464 | B2 * | 4/2011 | Adachi et al. | 417/420 |
| 2007/0243085 | A1 * | 10/2007 | Adachi et al. | 417/420 |
| 2007/0253836 | A1 * | 11/2007 | Jeon | 417/223 |

FOREIGN PATENT DOCUMENTS

| | | |
|---|---|---|
| DE | 691 449 A | 5/1940 |
| DE | 10 2004 054 637 A1 | 5/2006 |
| JP | U-05-058832 | 8/1993 |

* cited by examiner

*Primary Examiner* — Devon C Kramer
*Assistant Examiner* — Peter J Bertheaud
(74) *Attorney, Agent, or Firm* — Oliff & Berridge, PLC

(57) ABSTRACT

A pulley is fixed to a housing of a water pump, the pulley being connected to an output shaft of an internal combustion engine so that the pulley is driven through the output shaft. In the housing, a slider moves to and fro due to a change in pressure in a pressure chamber, which causes the magnetic flux passing through a magnet and an inductor ring of a rotary cylinder to vary, so that the driving force of the internal combustion engine is variably transmitted to the rotary cylinder. The pressure chamber is connected to an intake air passage and an atmospheric air introducing portion through a pressure path, and the state of communication is changed by a VSV. The pressure passage is provided with an orifice for preventing rapid change in pressure in the pressure chamber when the VSV is switched.

10 Claims, 7 Drawing Sheets

PRESSURE-OPERATED MECHANISM AND WATER PUMP INCLUDING THE SAME

INCORPORATION BY REFERENCE

The disclosure of Japanese Patent Application No. 2007-073008 filed on Mar. 20, 2007, including the specification, drawings and abstract is incorporated herein by reference in its entirety.

BACKGROUND OF THE INVENTION

1. Field of Invention

The invention relates to a pressure-operated mechanism for driving a driven portion or controlling a controlled portion, according to a change in pressure in a pressure chamber, and relates to a water pump including the pressure-operated mechanism.

2. Description of Related Art

In an internal combustion engine, a water pump for circulating cooling water through the water jacket is used. In the water pump described in Japanese Utility Model Application Publication No. 5-58832 (JP-U-5-58832), for example, rotation of an impeller fixed to a rotary shaft causes circulation of cooling water. In the water pump, the driving force generated by the internal combustion engine is transmitted to the rotary shaft via a pulley, which rotates in synchronization with the internal combustion engine, and via a fluid coupling, thereby rotating the impeller. The water pump is configured so that the degree to which the rotary shaft and the fluid coupling are engaged becomes greater as temperature of the cooling water in the water jacket becomes higher. Thus, in the water pump, the higher the temperature of the cooling water in the water jacket is, the higher the rotational speed of the impeller is.

In recent years, as water pumps, of which the driving force transmitted to the rotor of the pump can be changed, those shown in FIGS. 5 and 6, for example, have been studied. As shown in FIG. 5, the water pump 100 includes: a circulation system 20 for circulating the cooling water; and a driving system 30 for driving a rotary cylinder 21 of the circulation system 20. A separation wall 40 for preventing cooling water from leaking from the circulation system 20 into the driving system 30 is provided between the circulation system 20 and the driving system 30.

A flow path 23 through which cooling water flows is formed in a cylinder block 22 of the internal combustion engine. A supporting shaft 25, one end of which is fixed to the separation wall 40, is provided in the flow path 23. At both ends of the supporting shaft 25, bearings 24*a* and 24*b* are provided, respectively. The supporting shaft 25 is inserted through the rotary cylinder 21, which is provided with vanes 26, whereby the rotary cylinder 21 is supported rotatably with respect to the supporting shaft 25. An end portion of the rotary cylinder 21 on the separation wall 40 side is fitted with an inductor ring 27 including an iron core.

The driving system 30 includes a housing 31, and a pulley 32 is fixed to the housing 31, the pulley 32 being connected to a crankshaft (not shown) of the internal combustion engine through a belt 33 so that the pulley 32 is driven through the crankshaft. In the housing 31, a slider 34 is provided, at least part of which is engaged with the housing 31 in a splined manner, the slider 34 being able to move to and fro in the axial direction of the rotary cylinder 21 in the housing 31. A magnet 35, which is made of neodymium, for example, is fitted onto an end portion of the slider 34 on the circulation system 20 side so that the magnet 35 surrounds the inductor ring 27 fitted onto the rotary cylinder 21. Each of the inductor ring 27 and the magnet 35 functions as a magnetic portion.

The slider 34 is always urged toward the circulation system 20 side by a spring 36 provided in the housing 31. The torque transmitted from the crankshaft to the housing 31 via the belt 33 and the pulley 32 is transmitted to the rotary cylinder 21 by means of the magnetic interaction that occurs between the inductor ring 27 and the magnet 35, whereby the rotary cylinder 21 is rotated. When the vanes 26 fixed to the rotary cylinder 21 rotates due to this rotation, the cooling water in the flow path 23 is pressure-fed to the water jacket (not shown) of the internal combustion engine.

The inside of the housing 31 is divided into an atmospheric chamber 31*a* and a pressure chamber 31*b* by the slider 34. A seal member 37 for sealing between the slider 34 and the inner surface of the housing 31 is provided on the outer surface of the slider 34, and the seal member 37 keeps the pressure chamber 31*b* airtight. When the pressure in the pressure chamber 31*b* varies, the slider 34 moves to and fro in the housing 31, whereby the amount of torque that is transmitted to the rotary cylinder 21 via the magnet 35 and the inductor ring 27 is changed. Thus, in the water pump 100, the rotary cylinder 21 is a rotary body that serves as the driven portion driven by the to-and-fro movement of the slider 34; the housing 31 and the slider 34 constitute the operation portion that drives the rotary cylinder 21 according to the change in pressure in the pressure chamber 31*b*; and the driving system 30 is the pressure-operated mechanism.

In the driving system 30, a pressure pipe 41 is inserted into the pressure chamber 31*b* of the housing 31. The pressure pipe 41 is supported by a bearing 42 provided in the housing 31 and fixed to another member (not shown), and the housing 31 is rotatable with respect to the pressure pipe 41. A seal 43 for preventing air from leaking out of the pressure chamber 31*b* is provided between the pressure pipe 41 and the inner surface of the housing 31. A pressure introducing pipe 52 is connected to the pressure pipe 41, and a vacuum switching valve (hereinafter referred to as the "VSV") 55, which serves as the switching portion, is provided on the pressure introducing pipe 52. The pressure introducing pipe 52 is branched via the VSV 55 at the end opposite to the end at which the pressure introducing pipe 52 is connected to the pressure pipe 41. One branch of the pressure introducing pipe 52 is connected to an intake air passage 57 on the downstream side of a throttle valve 62, and the other branch of the pressure introducing pipe 52 is connected to an atmospheric air introducing portion 54 into which atmospheric air is introduced, in the engine compartment. In the intake air passage 57, the portion downstream of the throttle valve 62 is a negative pressure area in which pressure is lower than the atmospheric pressure when the internal combustion engine is in operation. Specifically, the pressure pipe 41 and the pressure introducing pipe 52 constitute a pressure path 70, and the atmospheric air introducing portion 54 and the intake air passage 57 give a first pressure area and a second pressure area, respectively. Drive control of the VSV 55 is performed by an electronic controller 90, whereby the valve element position of the VSV 55 is changed, which causes the pressure chamber 31*b* to communicate with the intake air passage 57 or the atmospheric air introducing portion 54 selectively.

Specifically, when the signal for controlling the VSV 55, supplied from the electronic controller 90, is "OFF," the pressure chamber 31*b* communicates with the atmospheric air introducing portion 54, and the atmospheric air is introduced into the pressure chamber 31*b*, whereby the difference in pressure between the atmospheric chamber 31*a* and the pressure chamber 31*b* vanishes. Thus, as shown in FIG. 5, the slider 34 is urged by the urging force of the spring 36, and is displaced toward the circulation system 20. When this occurs, the magnet 35 provided on the slider 34 and the inductor ring 27 provided on the rotary cylinder 21 come close to each other in a facing relation, and therefore, the magnetic flux passing through the magnet 35 and the inductor ring 27 increases, and the torque transmitted from the slider 34 to the rotary cylinder 21 becomes relatively large. Thus, the amount of cooling water that is delivered or supplied to the water jacket due to the rotation of the vanes 26 of the rotary cylinder 21 also increases.

On the other hand, when the signal for controlling the VSV 55, supplied from the electronic controller 90, is "ON," the pressure chamber 31*b* communicates with the intake air passage 57, and the negative pressure of the intake air is introduced to the pressure chamber 31*b*, so that the difference in pressure between the pressure chamber 31*b* and the atmospheric chamber 31*a* causes the slider 34 to be displaced toward the pressure pipe 41 despite the urging force exerted by the spring 36, as shown in FIG. 6. Thus, the magnet 35 provided on the slider 34 and the inductor ring 27 provided on the rotary cylinder 21 come away from each other in the axial direction of the rotary cylinder 21, which causes the magnetic flux passing through the magnet 35 and the inductor ring 27 to be reduced as compared to the state shown in FIG. 5. Accordingly, the flow rate of the cooling water that is delivered or supplied to the water jacket is reduced.

In this way, in the water pump 100, the flow rate of the cooling water delivered or supplied to the water jacket is appropriately controlled by changing the valve element position of the VSV 55.

In the meantime, there is a water pump 100 in which the pressure introducing pipe 52 is detachable for the purpose of improving the ease of maintenance. Specifically, as shown in FIGS. 5 and 6, it is conceivable that the pressure introducing pipe 52 includes: a first connection pipe 58 that is attachable and detachable to and from the pressure pipe 41 and the VSV 55; and a second connection pipe 59 that is attachable and detachable to and from the VSV 55 and the intake air passage 57. In this case, when a mechanic removes the connection pipes 58 and 59 and leaves them as they are at the time of maintenance or inspection of a vehicle, for example, a problem can occur that it is impossible to cause an appropriate change in pressure in the pressure chamber 31*b* by switching the VSV 55.

Specifically, when the first connection pipe 58 is disconnected from the pressure pipe 41 or the VSV 55, and the second connection pipe 59 is disconnected from the VSV 55 or the intake air passage 57, the atmospheric air is always introduced into the pressure chamber 31*b*, and the pressure chamber 31*b* is maintained at the atmospheric pressure, so that the water pump 100 is always maintained in the state shown in FIG. 5. Thus, it is impossible to adjust the amount of cooling water delivered or supplied to the water jacket by means of the water pump 100.

A water pump 100 is available in which a detection section for, when the first and second connection pipes 58 and 59 are disconnected, detecting the disconnection using the fact that the conditions of flow in the pressure introducing pipe 52 change at the time of the disconnection.

The detection of the disconnection by the detection section is performed as follows, for example. Typically, in an internal combustion engine, the amount of air introduced into the combustion chamber is detected by an air flow meter 60 provided in the intake air passage 57, and the amount of fuel injected into the combustion chamber(s) is derived based on the amount of air detected by the air flow meter 60 in order to set the weight ratio between air and fuel in the combustion chamber to the desired air-fuel ratio. However, when the second connection pipe 59 is disconnected from the VSV 55, for example, air is introduced into the intake air passage 57 through the second connection pipe 59, and therefore, the amount of air introduced into the combustion chamber becomes greater than the amount of air that is detected by the air flow meter 60. For this reason, even when the amount of fuel injection is controlled based on the amount of air detected by the air flow meter 60 so that the air-fuel ratio in the combustion chamber becomes the desired air-fuel ratio, the actual air-fuel ratio becomes greater (leaner) than the desired air-fuel ratio. Thus, it is possible to detect the disconnection of the connection pipes 58 and 59 of the pressure introducing pipe 52 under such conditions. Also when the second connection pipe 59 is disconnected from the intake air passage 57, or when the first connection pipe 58 is disconnected from the VSV 55 or the pressure pipe 41, the disconnection of the connection pipe 58 or 59 can be detected similarly. Specifically, when the connection pipe 58 or 59 of the pressure introducing pipe 52 is disconnected, this abnormality, or disconnection, can be detected based on a change in the conditions of flow in the pressure introducing pipe 52, such as the event that air is introduced from the disconnection point into the intake air passage 57.

When it is determined whether the connection pipe 58 or 59 of the pressure introducing pipe 52 is disconnected, if the cross section of the passage of the pressure introducing pipe 52 is small, the amount of air introduced into the intake air passage 57 when the connection pipe 58 or 59 is disconnected is not so large. Thus, in view of detecting the disconnection, the larger the cross section of the passage of the pressure introducing pipe 52, the better. However, when the cross section of the passage of the pressure introducing pipe 52 is large, the speed at which the slider 34 moves to and fro when the pressure in the pressure chamber 31*b* rapidly changes at the time of switching the VSV 55 is high, which can cause degradation of durability of the components constituting the driving system 30, degradation of controllability of the internal combustion engine due to rapid change in the speed of rotation of the vanes 26, and increase in the sound of flow in the flow path 23.

The pulsation due to rapid change in pressure in the pressure chamber is a problem that can occur in a pressure-operated mechanism, other than the water pump, in which mechanism a driven portion is driven or a controlled portion is controlled according to a change in pressure in the pressure chamber. Specifically, when, in a pressure-operated mechanism, the pressure path includes the connection passage that is attachable and detachable to and from the pressure chamber, and the cross section of the passage of the pressure path has a size such that it is possible to detect disconnection, driving of the driven portion or control of the controlled portion is abruptly performed due to a rapid change in pressure in the pressure chamber, which can cause pulsation.

SUMMARY OF THE INVENTION

The invention provides a pressure-operated mechanism in which the cross section of the passage of a pressure path connecting a pressure chamber and pressure areas in which pressures are different from each other has a size such that it is possible to detect disconnection, and that is capable of reducing pulsation during operation of an operation portion when the pressure-operated mechanism is provided with the operation portion that drives a driven portion or controls a controlled portion, according to a change in pressure in the pressure chamber, and to provide a water pump including the pressure-operated mechanism.

A first aspect of the invention relates to a pressure-operated mechanism. The pressure-operated mechanism includes: a pressure chamber; an operation portion that drives a driven portion or controls a controlled portion, according to a change in pressure in the pressure chamber; a pressure path including a connection passage, one end of which is connected to the pressure chamber, the other end of which is branched and respectively connected to a first pressure area and a second pressure area in which pressure is lower than the pressure in the first pressure area, and at least part of which is attachable and detachable to and from the pressure chamber; a switching portion, provided on the pressure path, for changing a state of communication between the pressure chamber and the pressure areas in order to cause a change in pressure in the pressure chamber; and a disconnection detecting portion, connected to the pressure path, for detecting disconnection of the connection passage from the pressure chamber, based on a change in a condition of flow in the connection passage. The passage cross section of a section of the pressure path between a detachable portion of the connection passage and a connection portion of the disconnection detecting portion has a predetermined size such that detection of disconnection by the disconnection detecting portion is possible, and the pressure path has a pressure transmission-reducing portion for preventing a pressure in the pressure chamber from rapidly changing when the switching portion is switched.

With this configuration, the passage cross section of the section of the pressure path between the detachable portion of the connection passage and the connection portion of the disconnection detecting portion has the predetermined size, and it is therefore possible to detect disconnection by the disconnection detecting portion when the connection passage is disconnected. Because the pressure path is provided with the pressure transmission-reducing portion, even when the passage cross section of this section has the predetermined size, the pressure in the pressure chamber does not rapidly change when the state of communication between the pressure chamber and the pressure areas is changed when the switching portion is switched. Thus, it is possible to prevent pulsation from occurring when the operation portion drives the driven portion or controls the controlled portion according to the change in pressure in the pressure chamber. Even when the pressure transmission-reducing portion is provided on the disconnection detecting portion side of the detachable portion of the connection passage, if a configuration is adopted in which the pressure transmission-reducing portion can change the degree to which transmission of pressure is reduced, or if the pressure transmission reduction degree varies depending on conditions, it can be determined that the connection passage is disconnected when pressure transmission reduction degree becomes small.

A second aspect of the invention relates to a water pump. The water pump includes the above-described pressure-operated mechanism. In the water pump, the driven portion includes a rotor provided with a vane for circulating cooling water through the internal combustion engine and the radiator, the slider is configured to be rotated by a driving force generated by the internal combustion engine, and each of the slider and the rotor is provided with a magnetic portion, in which the amount of overlap in the axial direction varies due to the to-and-fro movement of the slider.

With this configuration, when the slider moves to and fro due to the change in pressure in the pressure chamber, the amount of magnetic flux that occurs between the magnetic portion of the slider and the magnetic portion of the rotor varies, which causes the rotational speed of the impeller to vary, and it is therefore possible to adjust the amount of circulation of cooling water. In addition, because the pressure transmission-reducing portion is provided, and therefore the slider does not rapidly slide when the slider moves to and fro, the amount of magnetic flux that occurs between the magnetic portion of the slider and the magnetic portion of the rotor does not rapidly increase, and consequently, the rotational speed of the impeller does not rapidly change. Thus, durability of the slider and its associated components is improved, and it is possible to suppress degradation of the controllability of the internal combustion engine and increase in the sound of flow in the coolant flow path that are both due to rapid change in the rotational speed of the impeller.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 2A shows a signal for controlling a vacuum switching valve, FIG. 2B shows pressure in a pressure chamber, and FIG. 2C shows rotational speed of the rotary cylinder of the water pump;

FIG. 4A shows a state in which a pressure chamber is caused to communicate with an atmospheric air introducing portion, FIG. 4B shows a state in which the pressure chamber is caused to communicate with both of the atmospheric air introducing portion and an intake air passage, and FIG. 4C shows a state in which the pressure chamber is caused to communicate with the intake air passage;

DETAILED DESCRIPTION OF EMBODIMENTS

First Embodiment

Figure 1:
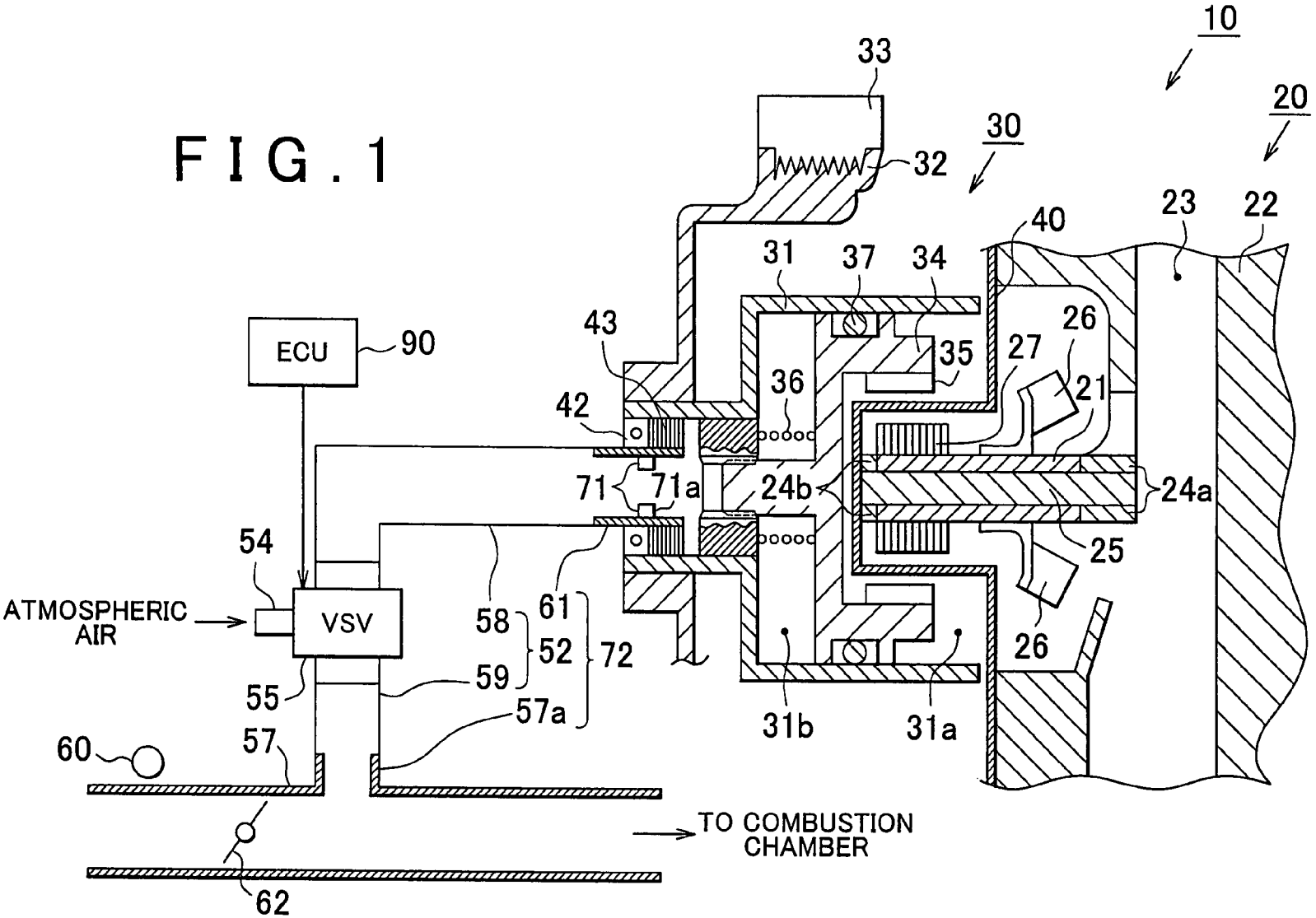
FIG. 1 is a schematic diagram showing a water pump in which a pressure-operated mechanism according to a first embodiment of the invention is used.
Figure 5:
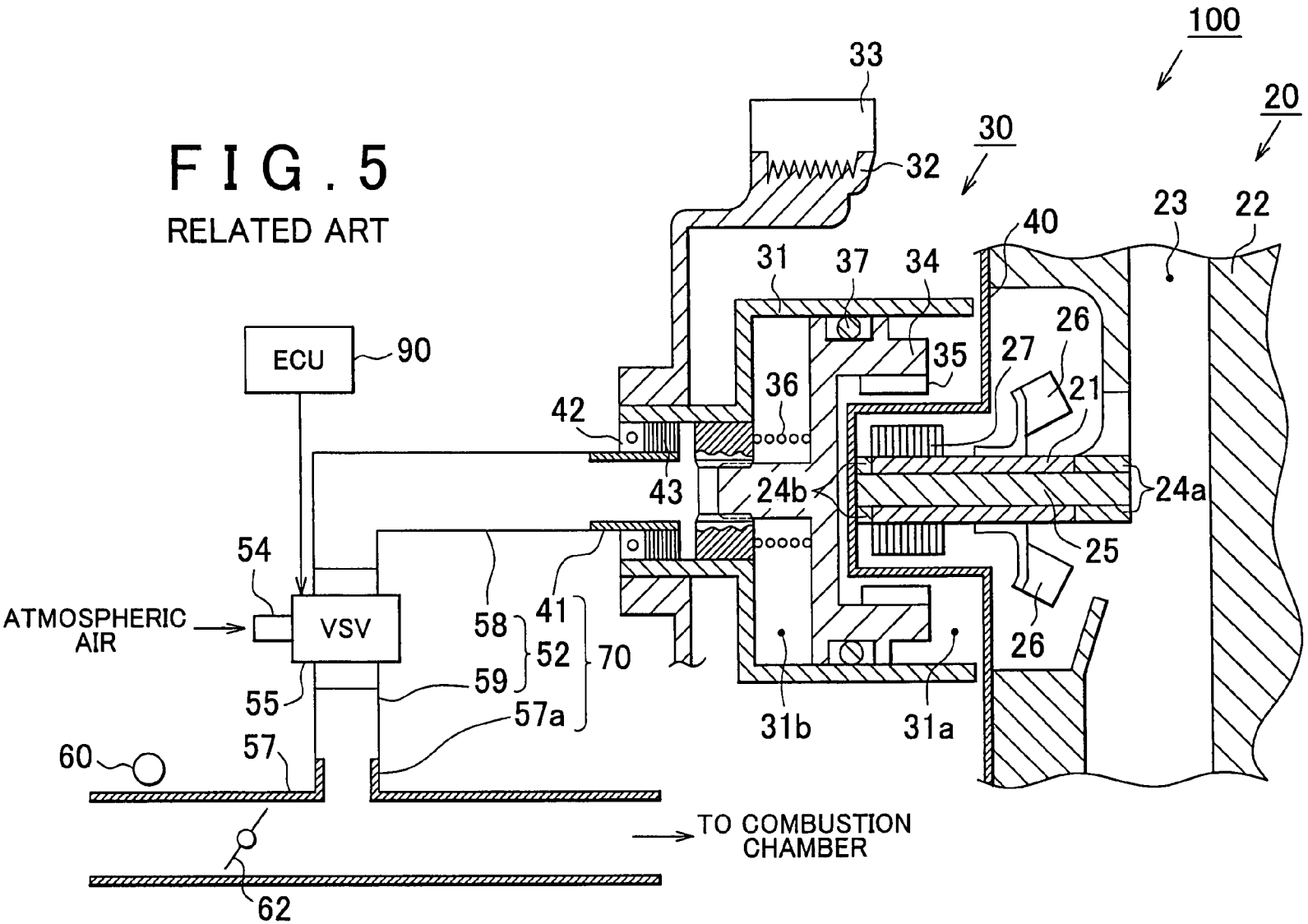
FIG. 5 RELATED ART
FIG. 5 is a schematic diagram showing a state in which the flow rate of cooling water is relatively increased in a water pump in which a pressure-operated mechanism of related art is used.
Figure 6:
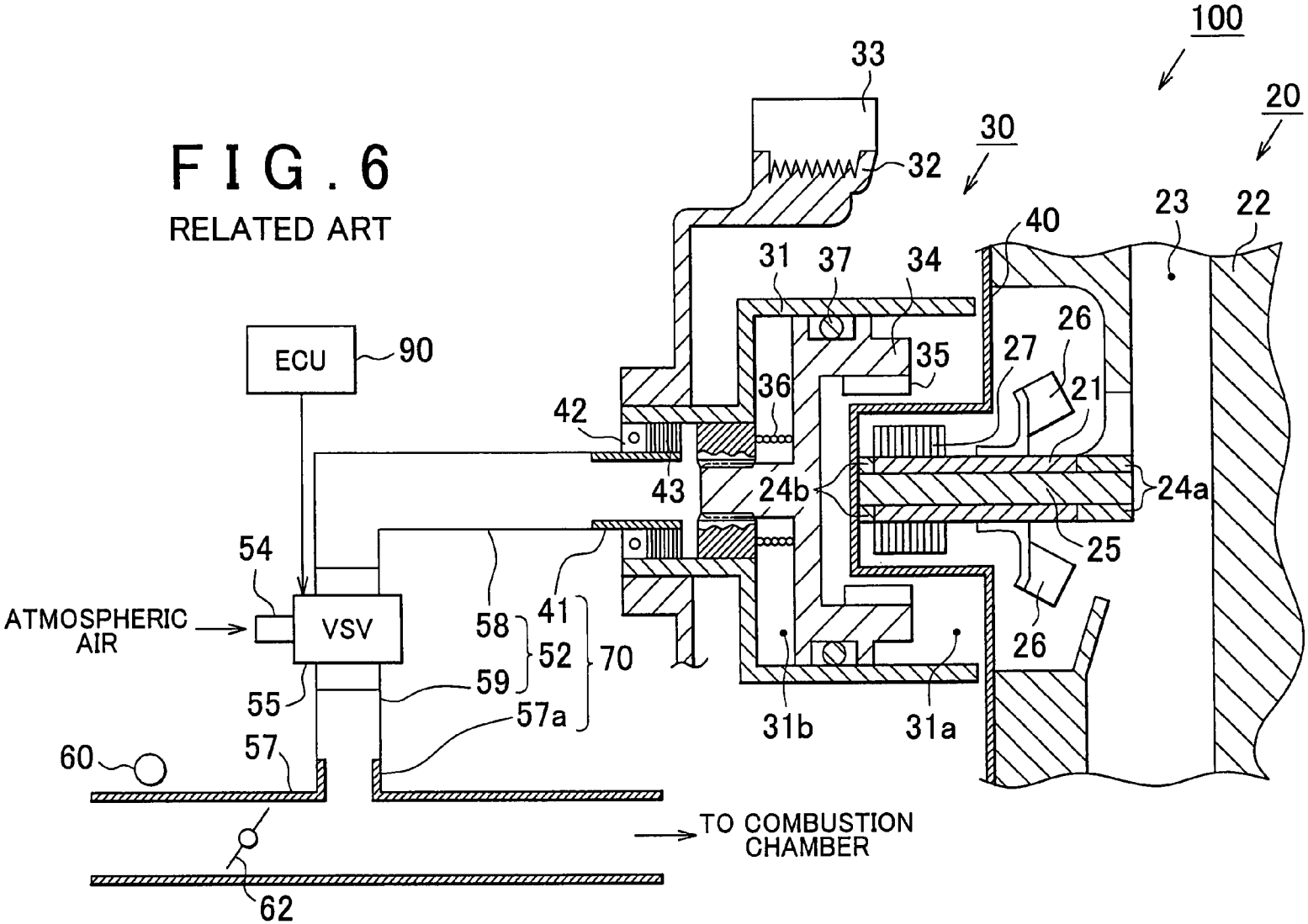
FIG. 6 RELATED ART
FIG. 6 is a schematic diagram showing a state in which the flow rate of cooling water is relatively decreased in the water pump in which the pressure-operated mechanism of related art is used.

Referring to FIGS. 1 and 2, a first embodiment in which a pressure-operated mechanism according to the invention is applied to a water pump 10 for circulating cooling water of an internal combustion engine will be described. FIG. 1 shows the water pump 10 and a controller thereof. In FIG. 1, the member that has the same function as that of the corresponding member shown in FIG. 5 described above will be denoted by the same reference numeral, and the description thereof will be omitted.

As shown in FIG. 1, in the water pump 10 according to the embodiment, a pressure chamber 31*b* that is defined by a housing 31 and a slider 34 in the housing 31 is connected to an atmospheric air introducing portion 54 and an intake air passage 57 via a pressure path 72.

More specifically, in the pressure path 72, a second connection pipe 59 connected to the intake air passage 57 is connected to the intake air passage 57 through a cylindrical joint pipe 57*a* that is joined to the intake air passage 57 so as to be continuous with an inner circumferential surface of the intake air passage 57. The joint pipe 57*a* also constitutes part of the pressure path 72. Disconnection of a first connection pipe 58 from a pressure pipe 61 means disconnection of the first and second connection pipes 58 and 59 and the joint pipe 57*a* from the pressure chamber 31*b*. Disconnection of at least one of the first and second connection pipes 58 and 59 from a VSV 55 means disconnection of the second connection pipe 59 and the joint pipe 57*a* from the pressure chamber 31*b*. Disconnection of the second connection pipe 59 from the joint pipe 57*a* means disconnection of the joint pipe 57*a* from the pressure chamber 31*b*. In this way, the connection passage is configured so that the first and second connection pipes 58 and 59 and the joint pipe 57*a* are attachable and detachable to and from the pressure chamber 31*b*.

The VSV 55 provided on the pressure path 72 is configured so as to be able to selectively switch between a state in which the VSV 55 causes the pressure chamber 31*b* to communicate with the atmospheric air introducing portion 54 and a state in which the VSV 55 causes the pressure chamber 31*b* to communicate with the intake air passage 57.

When at least one of the first and second connection pipes 58 and 59 of the pressure path 72 is disconnected, that is, when the connection passage, serving as the pressure path 72, is disconnected from the pressure chamber 31*b*, a difference between the detection result of an air flow meter 60 and the detection result of an air-fuel ratio sensor (not shown) occurs, and it is therefore possible to detect the disconnection. A disconnection detecting portion for detecting disconnection of the connection passage from the pressure chamber 31*b* is constituted of the intake air passage 57, the air flow meter 60, the air-fuel ratio sensor (not shown), and an electronic controller 90 described above. The connection portion between the disconnection detecting portion and the pressure path 72 is located at the position at which the joint pipe 57*a* is joined to the intake air passage 57. The first and second connection pipes 58 and 59 and the joint pipe 57*a* are formed to have the passage cross section with a predetermined size such that the disconnection detecting portion can detect a disconnection. These pipes 57*a*, 58, and 59 are formed to have a passage cross section equal to or greater than a certain size so that, when at least one of the connection pipes 58 and 59 is disconnected, a sufficient amount of air is introduced into the intake air passage 57 from the point of disconnection, and a difference between the detection result of the air flow meter 60 and the detection result of the air-fuel ratio sensor surely occurs. The predetermined size herein does not mean a constant size, that is, the passage cross section may partially vary as long as the passage cross section is equal to or greater than the minimum passage cross section with which it is possible to detect a disconnection. The opening of the valve when the VSV 55 has been switched also has the predetermined size. Thus, when the connection passage of the pressure path 72 is disconnected from the pressure chamber 31*b*, the disconnection is detected.

In the pressure path 72, the pressure pipe 61 is supported by a bearing 42 provided in the housing 31 as in the case of the pressure pipe 41 of the above-described related art. At the time of a normal maintenance, the pressure pipe 61 is not detached from the housing 31. The pressure pipe 61 is fixed to the pressure chamber 31*b*, and the first and second connection pipes 58 and 59 and the joint pipe 57*a* are attachable and detachable to and from the pressure pipe 61. The pressure pipe 61 is formed to have a passage cross section with the above-described predetermined size. However, the pressure pipe 61 is provided with an orifice 71 having a passage cross section that is smaller than the passage cross section with the predetermined size. The orifice 71 may be regarded as the pressure transmission-reducing portion, or a throat portion of the invention. The cross section of an opening 71*a* of the orifice 71 has a size smaller than the above-described predetermined size.

Figures 2A, 2B, 2C:
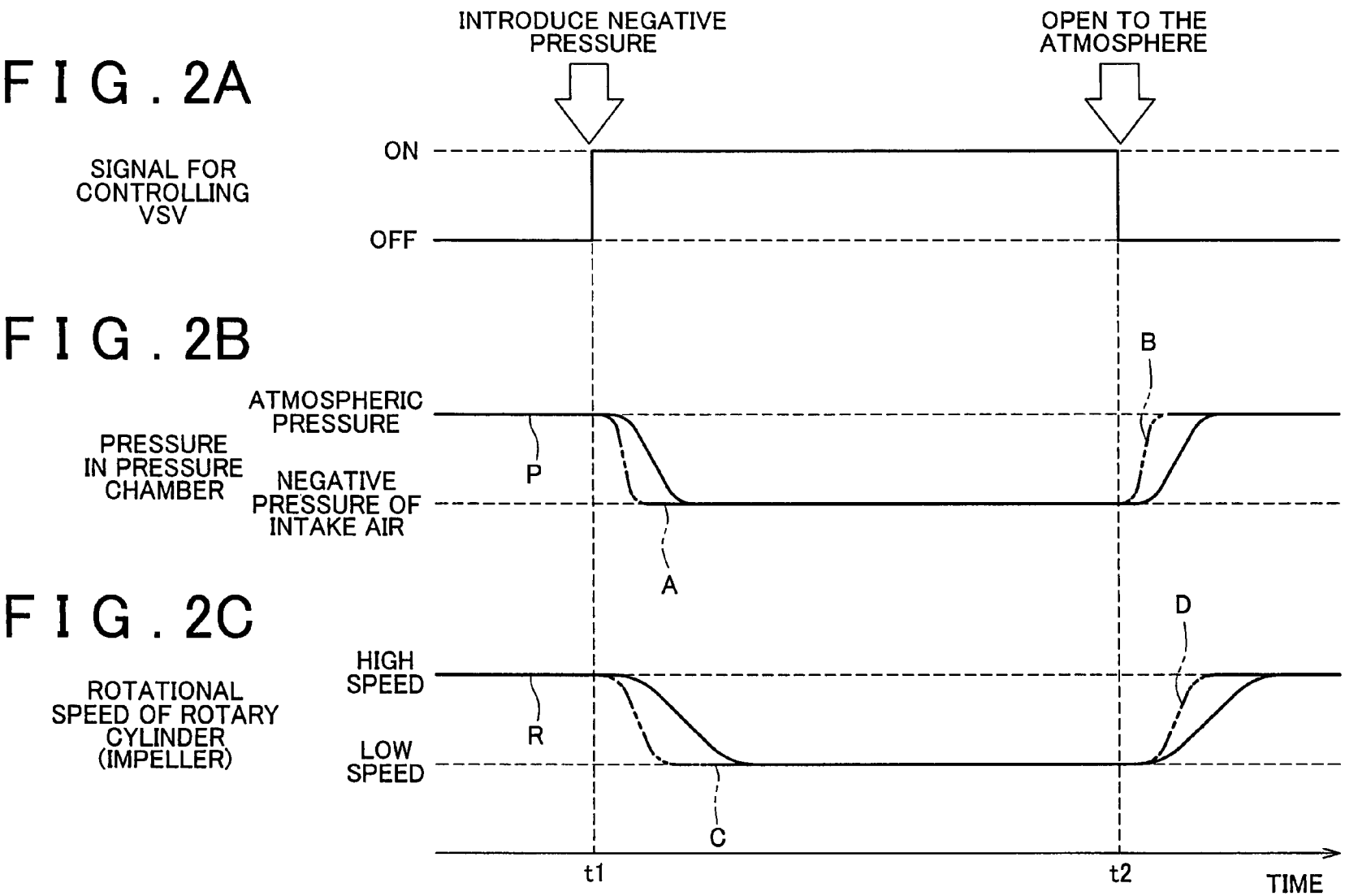
FIGS. 2A to 2C are time charts illustrating control of the rotational speed of vanes on a rotary cylinder of the water pump, where

Next, change of the valve element position of the VSV 55 of the present embodiment and variation in the rotational speed of a rotary cylinder 21 of the pump 10 at the time of the switching will be described with reference to FIGS. 2A to 2C. As shown in FIGS. 2A to 2C, when the signal for controlling the VSV 55 supplied from the electronic controller 90 is turned from "OFF" to "ON" at t1, the valve element position of the VSV 55 is changed, and a transition is made from the state in which the VSV 55 causes the pressure chamber 31*b* to communicate with the atmospheric air introducing portion 54 to the state in which the VSV 55 causes the pressure chamber 31*b* to communicate with the intake air passage 57. Thus, the pressure in the intake air passage 57 is transmitted to the pressure chamber 31*b* to cause the pressure in the pressure chamber 31*b* to decrease from the atmospheric pressure to the negative pressure of the intake air in the intake air passage 57. As described above, in the present embodiment, in the pressure path 72, the pressure pipe 61 is provided with the orifice 71. Thus, when the signal for controlling the VSV 55 is turned from "OFF" to "ON," the negative pressure of the intake air in the intake air passage 57 is transmitted to the pressure chamber 31*b* through the orifice 71 at which the passage cross section of the pressure path 72 is partially reduced, so that the negative pressure of the intake air is not rapidly transmitted. Regarding FIG. 2B, in the case of related art, when the signal for controlling the VSV 55 is turned from "OFF" to "ON", the pressure in the pressure chamber 31*b* rapidly changes from the atmospheric pressure to the negative pressure of the intake air as shown by the chain double-dashed line A. In the present embodiment, as shown by the solid line P, the pressure in the pressure chamber 31*b* changes more slowly than in the case shown by the chain double-dashed line A. Thus, although the change in pressure in the pressure chamber 31*b* causes the slider 34 to be displaced toward the pressure pipe 61 despite the urging force exerted by the spring 36, the speed of the displacement is lower than the corresponding speed in the case of related art, so that, as shown by the solid line R in FIG. 2C, the rotational speed of the rotary cylinder 21 changes more slowly than in the case of related art shown by the chain double-dashed line C when the rotational speed of the rotary cylinder 21 varies from high speed to low speed.

By contrast, when, as shown in FIG. 2A, the signal for controlling the VSV 55 supplied from the electronic controller 90 is turned from "ON" to "OFF" at t2, for example, the valve element position of the VSV 55 is changed, and a transition is made from the state in which the VSV 55 causes the pressure chamber 31*b* to communicate with the intake air passage 57 to the state in which the VSV 55 causes the pressure chamber 31*b* to communicate with the atmospheric air introducing portion 54. Thus, the atmospheric pressure is transmitted to the pressure chamber 31*b* to cause the pressure in the pressure chamber 31*b* to increase from the negative pressure of the intake air in the intake air passage 57 to the atmospheric pressure. As described above, in the present embodiment, on the pressure path, the pressure pipe 61 is provided with the orifice 71. Thus, when the signal for controlling the VSV 55 is turned from "ON" to "OFF," the atmospheric pressure is transmitted to the pressure chamber 31*b* through the orifice 71 at which the passage cross section of the pressure path 72 is partially reduced, so that the atmospheric pressure is not rapidly transmitted. Regarding FIG. 2B, in the case of related art, when the signal for controlling the VSV 55 is turned from "ON" to "OFF," the pressure in the pressure chamber 31*b* rapidly changes from the negative pressure of the intake air to the atmospheric pressure as shown by the chain double-dashed line B. In the present embodiment, however, as shown by the solid line P, the pressure in the pressure chamber 31*b* changes slowly. Thus, although the change in pressure in the pressure chamber 31*b* causes the slider 34 to be displaced toward the circulation system 20 due to the urging force exerted by the spring 36, the speed of this displacement is lower than the corresponding speed in the case of related art, so that, as shown by the solid line R in FIG. 2C, the rotational speed of the rotary cylinder 21 changes more slowly than in the case of related art shown by the chain double-dashed line D when the rotational speed of the rotary cylinder 21 varies from high speed to low speed.

As described in detail above, the following advantages are achieved by the water pump 10 in which the pressure-operated mechanism of the present embodiment is used. (1) In the water pump 10 of the present embodiment, in the pressure path 72, the first and second connection pipes 58 and 59 and the joint pipe 57*a* are formed to have the passage cross section with a predetermined size such that the disconnection detecting portion can detect a disconnection. The pressure pipe 61 of the pressure path 72 is provided with the orifice 71 for preventing the rapid change in the pressure in the pressure chamber 31*b* when the VSV 55 is switched.

Thus, when a state occurs in which the first and second connection pipes 58 and 59 and the joint pipe 57*a* are disconnected from the pressure chamber 31*b*, the disconnection is detected. When the VSV 55 is switched, the pressure applied through one of the atmospheric air introducing portion 54 and the intake air passage 57 that is caused to communicate with the pressure chamber 31*b* by this switching operation is transmitted to the pressure chamber 31*b*. This pressure is transmitted through the orifice 71 of which the passage cross section is smaller than the predetermined size even when the first and second connection pipes 58 and 59, and the joint pipe 57*a* are formed to have the passage cross section with the predetermined size. Thus, the pressure in the pressure chamber 31*b* slowly changes, and the speed at which the slider 34 slides is therefore slower than that in the case of related art, so that the rotational speed of the rotary cylinder 21 that varies as the slider 34 moves to and fro also slowly changes. Accordingly, the durability of the slider 34 and its associated components is improved, and it is possible to suppress degradation of the controllability of the internal combustion engine and increase in the sound of flow of the cooling water in the flow path 23 that are both due to a rapid change in the rotational speed of the impeller 26.

(2) In the case of the water pump 10 of the present embodiment, in the pressure path 72, the pressure pipe 61 fixed to the pressure chamber 31*b* is provided with the orifice 71. Thus, the section of the pressure path 72 that is located on the disconnection detecting portion side of the pressure pipe 61 may be formed to have the passage cross section with the predetermined size. More specifically, when the pressure pipe 61 is provided with the orifice 71, it is possible to set the passage cross section of the entire connection passage, constituted of the first and second connection pipes 58 and 59 and the joint pipe 57*a*, to the above-described predetermined size. Thus, when at least one of the first and second connection pipes 58 and 59 and the joint pipe 57*a* is disconnected from the pressure chamber 31*b*, it is possible to surely detect the disconnection.

(3) In the water pump 10 of the present embodiment, the orifice 71 instead of a narrow, pipe-like member is provided as a throat portion, so that it is possible to reduce the possibility of clogging of the pressure path 72.

Second Embodiment

Next, a water pump 11 according to a second embodiment of the invention will be described with reference to FIG. 3.

The second embodiment is different from the first embodiment in that, instead of providing the orifice 71, serving as the throat portion, in the pressure pipe 61 of the pressure path 72, the cross section of the passage of the pressure pipe 76 of the pressure path 75 is set smaller than the predetermined size.

Figure 3:
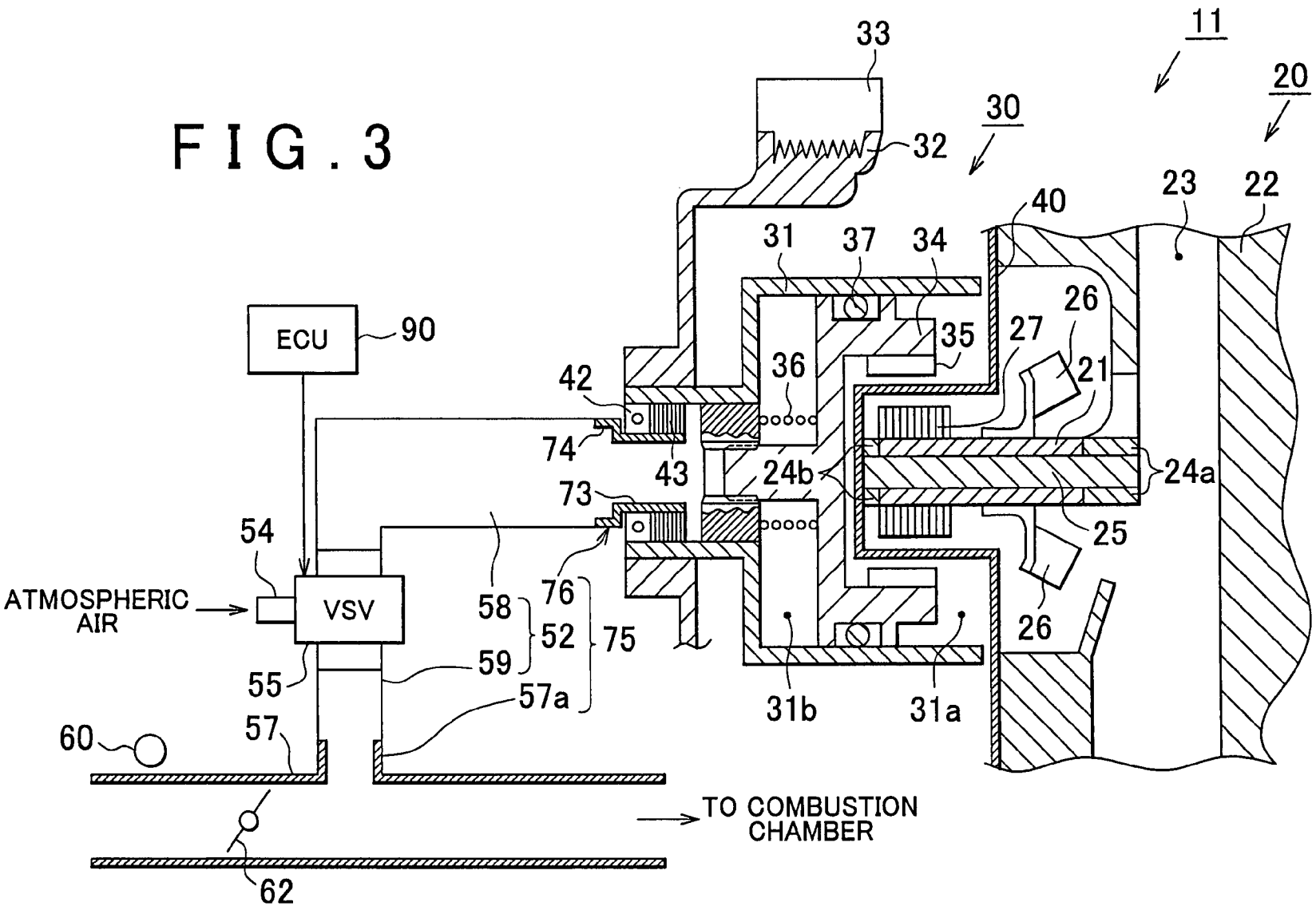
FIG. 3 is a schematic diagram showing a water pump in which a pressure-operated mechanism according to a second embodiment of the invention is used.

Specifically, as shown in FIG. 3, a pipe main portion 73, which is located on the pressure chamber 31*b* side, and a pipe joint portion 74, which is formed to have a diameter greater than that of the pipe main portion 73 and connected to the first connection pipe 58, are integrally formed to obtain the pressure pipe 76 of the present embodiment. The pipe main portion 73 of the pressure pipe 76 is supported by the bearing 42 provided in the housing 31, and the pipe joint portion 74 thereof is exposed from the housing 31.

In the pressure pipe 76 of the present embodiment, the cross section of the passage of the pipe joint portion 74 has a size substantially equal to the size of the cross section of the passage of the first connection pipe 58, that is, the predetermined size. However, the passage cross section of the pipe main portion 73 is smaller than the predetermined size. The pipe main portion 73 may be regarded as the pressure transmission-reducing portion, or a throat portion, of the invention. Because the pressure pipe 76 is formed so that the diameter of the portion of the pressure pipe 76, which portion is supported by the housing 31, is smaller than that of the pressure pipe 61 of the first embodiment, the shape of the housing 31 is such that the portion of the housing 31, which portion supports the pressure pipe 76, has a diameter smaller than the diameter of the corresponding portion of the housing 31 of the first embodiment. However, other constituent elements that are not particularly mentioned are the same as the corresponding elements of the first embodiment.

Also when the pipe main portion 73 serves as the throat portion, the advantages (1) and (2) described in relation to the first embodiment are achieved.

Third Embodiment

Next, a water pump according to a third embodiment of the invention will be described with reference to FIG. 4. FIG. 4 is a schematic diagram showing a construction around a pressure path 77 and its controller of the driving system of the water pump of the present embodiment.

The third embodiment is different from the first and second embodiments in that, instead of using the throat portion provided on the pressure path as the pressure transmission-reducing portion, the pressure transmission-reducing portion is realized in the form of a VSV 80, which serves as the switching portion.

Figure 4A:
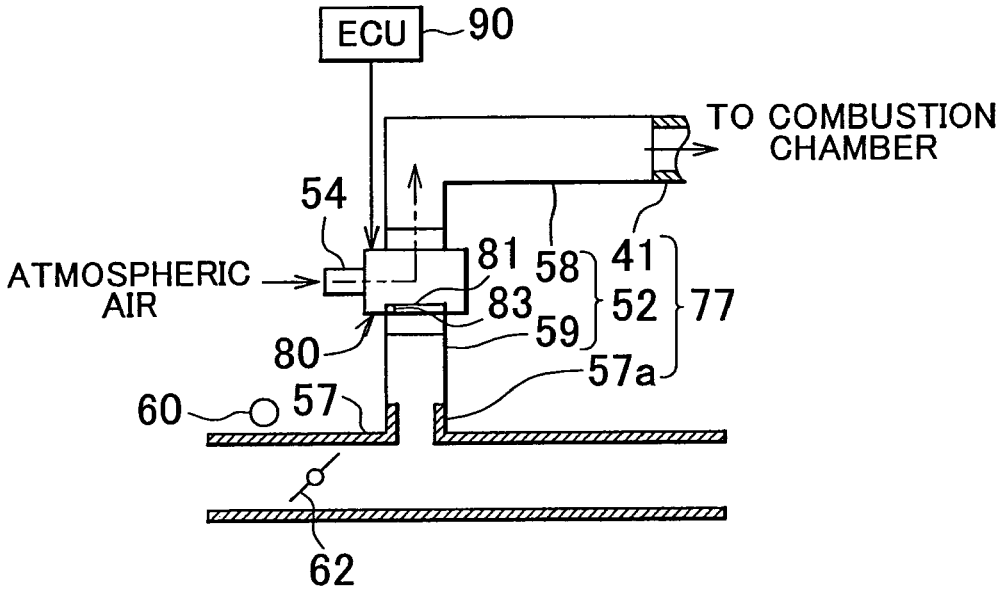
FIGS. 4A to 4C are schematic diagrams showing states of a pressure path and valve element positions of a vacuum switching valve in a water pump in which a pressure-operated mechanism according to a third embodiment of the invention is used, where
Figure 4B:
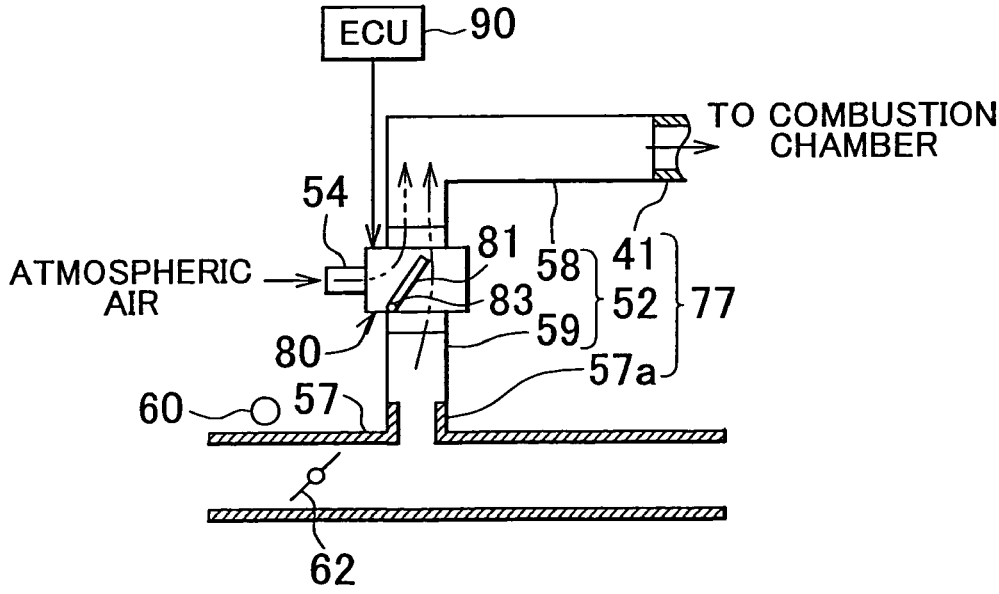
Figure 4C:
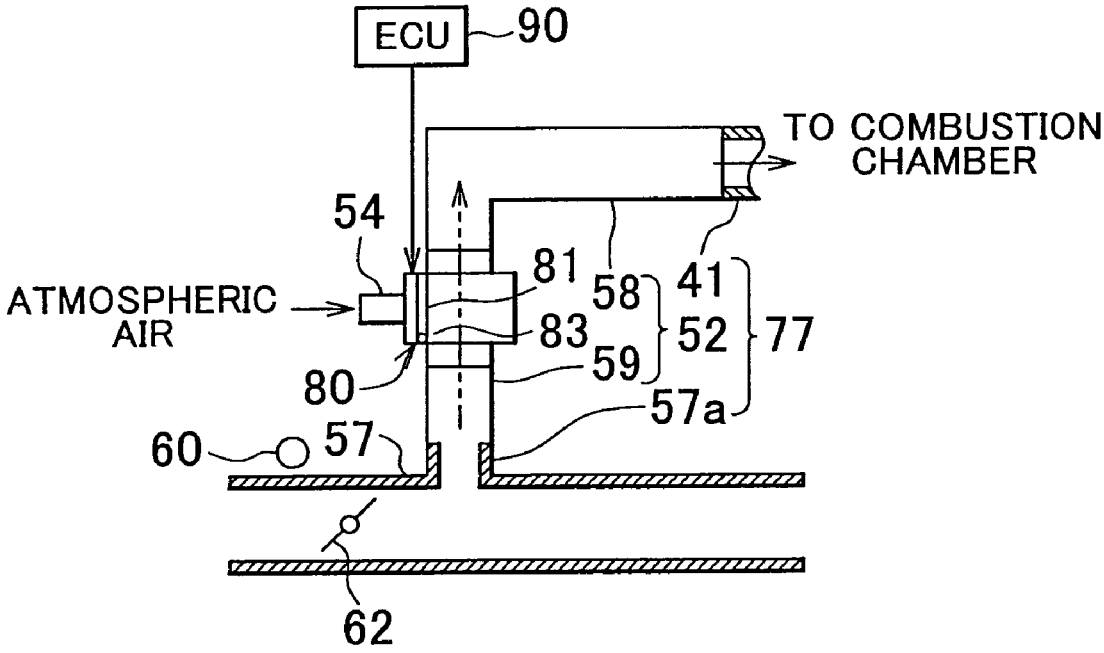

Specifically, in the first and second embodiments, the VSV 55 is configured so as to be able to selectively switch between a state in which the VSV 55 causes the pressure chamber 31*b* to communicate with the atmospheric air introducing portion 54 and a state in which the VSV 55 causes the pressure chamber 31*b* to communicate with the intake air passage 57. However, the VSV 80 of the present embodiment is configured so as to be able to selectively switch between a state in which the VSV 80 causes the pressure chamber 31*b* to communicate with the atmospheric air introducing portion 54 and a state in which the VSV 80 causes the pressure chamber 31*b* to communicate with the intake air passage 57. Specifically, as shown in FIG. 4, the VSV 80 includes a valve element 81 and a shaft 83 that pivotally supports the valve element 81. The VSV 80 is configured so that one of a state in which the VSV 80 causes the pressure chamber 31*b* shown in FIG. 4A to communicate with the atmospheric air introducing portion 54 and a state in which the VSV 80 causes the pressure chamber 31*b* to communicate with the intake air passage 57 is selectively maintained by pivoting the valve element 81 about the shaft 83. In addition, the VSV 80 is configured so that the valve element 81 pivots about the shaft 83 and maintains a medium state in which the VSV 80 causes the pressure chamber 31*b* to communicate with both of the atmospheric air introducing portion 54 and the intake air passage 57. In FIGS. 4A to 4C, the arrows of chain double-dashed lines indicate the status of pressure transmission from the atmospheric air introducing portion 54 and the intake air passage 57 into the pressure chamber 31*b* in each state.

When a transition is made from a state in which the VSV 80 causes the pressure chamber 31*b* to communicate with the atmospheric air introducing portion 54 to a state in which the VSV 80 causes the pressure chamber 31*b* to communicate with the intake air passage 57, the medium state shown in FIG. 4B is maintained for a predetermined period of time. Thus, it is possible to prevent the pressure in the intake air passage 57 from being rapidly transmitted to the pressure chamber 31*b*, and it is therefore possible to prevent the pressure in the pressure chamber 31*b* from rapidly changing from the atmospheric pressure to the negative pressure in the intake air passage 57. When a transition is made from a state shown in FIG. 4C in which the VSV 80 causes the pressure chamber 31*b* to communicate with the intake air passage 57 to a state shown in FIG. 4A in which the VSV 80 causes the pressure chamber 31*b* to communicate with the atmospheric air introducing portion 54, the medium state shown in FIG. 4B is maintained for a predetermined period of time. Thus, it is possible to prevent the pressure in the atmospheric air introducing portion 54 from being rapidly transmitted to the pressure chamber 31*b*, and it is therefore possible to prevent the pressure in the pressure chamber 31*b* from rapidly changing from the negative pressure of the intake air in the intake air passage 57 to the atmospheric pressure.

It suffices that the medium state, in which the pressure chamber 31*b* communicates with the atmospheric air introducing portion 54 and the intake air passage 57, is such that the pressure chamber 31*b* communicates with both of the atmospheric air introducing portion 54 and the intake air passage 57. That is, it is unnecessary that the degree to which the pressure chamber 31*b* is open to the atmospheric air introducing portion 54 and the degree to which the pressure chamber 31*b* is open to the intake air passage 57, which are shown in FIG. 4B, are substantially the same. Specifically, for example, when the state of the passage to the pressure chamber 31*b* is changed from the state shown in FIG. 4A to the state shown in FIG. 4C by means of the VSV 80, multiple medium states may be taken. Alternatively, a configuration may be adopted in which the degree to which the pressure chamber 31*b* is open to the atmospheric air introducing portion 54 and the intake air passage 57 can be steplessly changed and maintained at every moment by the VSV 80, and when a transition is made from the state shown in FIG. 4A to the state shown in FIG. 4C, the valve element 81 substantially steplessly and slowly pivots about the shaft 83 to change the valve element position.

Also in the present embodiment, the cross section of the passage of the first and second connection pipes 58 and 59 and the joint pipe 57*a* is set to a predetermined size, and when at least one of these pipes is disconnected from the pressure chamber 31*b*, it is possible to detect the disconnection. When the detachable portion of the first connection pipe 58 is disconnected, for example, the disconnection of the pressure path 77 is detected if the state, shown in FIG. 4C, in which the VSV 80 would cause the pressure chamber 31*b* to communicate with the intake air passage 57 is brought about, that is, if the degree to which the VSV 80 reduces the pressure transmission is small. Other constituent elements and operations, not particularly mentioned, are the same as those of the above-described first and second embodiments.

As described above, the following advantage (4) is achieved by the present embodiment. (4) In the water pump 10 of the present embodiment, the VSV 80, which serves as the pressure transmission-reducing portion, is configured so as to be able to switch stepwise between a state in which the VSV 80 causes the pressure chamber 31*b* to communicate with the atmospheric air introducing portion 54 and a state in which the VSV 80 causes the pressure chamber 31*b* to communicate with the intake air passage 57. Thus, by maintaining the medium state in which the VSV 80 causes the pressure chamber 31*b* to communicate with both of the atmospheric air introducing portion 54 and the intake air passage 57 for a predetermined period of time, it is possible to prevent the pressure in the pressure chamber 31*b* from rapidly changing to the negative pressure in the intake air passage 57 when a transition is made from a state in which the VSV 80 causes the pressure chamber 31*b* to communicate with the atmospheric air introducing portion 54 to a state in which the VSV 80 causes the pressure chamber 31*b* to communicate with the intake air passage 57. In addition, by maintaining the medium state for the predetermined period of time similarly, it is possible to prevent the pressure in the pressure chamber 31*b* from rapidly changing to the atmospheric pressure also when a transition is made from a state in which the VSV 80 causes the pressure chamber 31*b* to communicate with the intake air passage 57 to a state in which the VSV 80 causes the pressure chamber 31*b* to communicate with the atmospheric air introducing portion 54. Thus, also in the present embodiment, when the VSV 80 switches, the pressure in the pressure chamber 31*b* slowly changes, and the speed at which the slider 34 slides is therefore slower than that in the case of related art, so that the rotational speed of the rotary cylinder 21 that changes as the slider 34 moves to and fro also slowly changes. Accordingly, the durability of the slider 34 and its associated components is improved, and it is possible to suppress degradation of the controllability of the internal combustion engine and increase in the sound of flow of the cooling water in the flow path 23 that are both due to rapid change in the rotational speed of the impeller 26.

Other Embodiments

It is possible to modify the above-described embodiments as follows, for example. Although the throat portion, serving as the pressure transmission-reducing portion, is provided in the pressure pipe 61 or 76 that is fixed to the pressure chamber 31*b* in the first and second embodiments, a throat portion may be provided, on the pressure path, in the connection passage that is attachable and detachable to and from the pressure chamber 31*b*, instead of providing a throat portion in the pressure pipe 61 or 76.

Specifically, a throat portion, of which the cross section of the passage is smaller than the predetermined size, may be provided in the first connection pipe 58, for example. In this case, although it is difficult to detect the disconnection of the first connection pipe 58 from the pressure pipe 61 or 76, it is possible to detect the disconnection of the first connection pipe 58 from the VSV 55 and the disconnection of the second connection pipe 59 from the VSV 55 or the joint pipe 57*a*, because air, the amount of which is such that it is possible to detect the disconnection, flows from the point of disconnection into the intake air passage 57. Thus, this is still effective when the first connection pipe 58 is not disconnected from the pressure pipe 61 or 76 at the time of a normal maintenance, for example. In addition, when a throat portion, of which the cross section of the passage is smaller than the predetermined size, is provided in the second connection pipe 59, for example, it is possible to detect a disconnection of the second connection pipe 59 from the joint pipe 57*a* because air, the amount of which is such that it is possible to detect the disconnection, flows from the joint pipe 57*a* into the intake air passage 57. Also in this case, it is possible to prevent the pressure in the pressure chamber 31*b* from rapidly changing.

Although the disconnection detecting portion is constituted of the intake air passage 57, the air flow meter 60, the air-fuel ratio sensor, and the electronic controller 90, the configuration of the disconnection detecting portion and the point at which the disconnection detecting portion and the pressure path are connected is not particularly limited. For example, also when a disconnection detecting portion capable of detecting disconnection of a connection passage based on the change in flow conditions is provided in the middle of the second connection pipe 59 in a manner different from that of the above configurations, it is possible to detect the disconnection of the first connection pipe 58 from the pressure chamber 31*b* and the disconnection of the first connection pipe 58 from the VSV 55 or 80 because the flow conditions in the second connection pipe 59 changes due to the disconnection.

The above-described embodiments may be appropriately combined. Specifically, the first and third embodiments, for example, may be combined. That is, the pressure-operated mechanism may be designed so that stepwise transition, using the VSV 80 shown in FIGS. 4A to 4C, between a state in which the VSV 80 causes the pressure chamber 31*b* to communicate with the atmospheric air introducing portion 54 and a state in which the VSV 80 causes the pressure chamber 31*b* to communicate with the intake air passage 57 is possible, and at the same time, the orifice 71 may be provided in the pressure pipe 61 of the pressure path 72 as shown in FIG. 1. Alternatively, the second and third embodiments may be combined.

Although in the above-described embodiments, the intake air passage 57 is used as the negative pressure area, instead of this intake air passage 57, a negative pressure chamber of a vacuum pump or a brake booster, in which negative pressure occurs when the internal combustion engine is in operation, may be used as the negative pressure area. In addition, the pressures in the two areas that communicate with the pressure chamber 31*b* are not limited to the atmospheric pressure and the negative pressure. It suffices that the pressures are different from each other.

The specific configuration of the water pump 10 is not particularly limited to the forms shown in the above-described embodiments. For example, although the slider 34 is provided with the magnet 35, and the rotary cylinder 21 is provided with the inductor ring 27, the rotary cylinder 21 may be provided with the magnet 35, and the slider 34 may be provided with the inductor ring 27. In summary, it suffices that the water pump 10 is designed so that magnetic interaction occurs between the slider 34 and the rotary cylinder 21. Alternatively, instead of utilizing magnetic interaction to transmit torque to the rotary cylinder 21, a configuration may be adopted in which torque is transmitted to the rotary cylinder 21 with the use of friction clutches, for example, so that the degree of engagement between the slider and the rotary cylinder is variable.

In the above-described embodiments, the slider 34 moves to and fro due to the change in pressure in the pressure chamber 31*b*, whereby it is made possible to change the rotational speed of the rotary cylinder 21. Specifically, the slider 34 drives the rotary cylinder 21, which serves as the driven portion. However, the operation portion may control a controlled portion, for example, instead of driving the driven portion, according to the change in pressure in the pressure chamber 31*b*. Specifically, the operation portion may be such that a sensor for detecting a change in pressure in the pressure chamber is provided, and that when the change in pressure in the pressure chamber due to switching of the switching portion is detected, a signal indicating the change in pressure is supplied to the controlled portion.

In the above-described embodiments, the slider 34 transmits the driving force of the internal combustion engine to the rotary cylinder 21. However, a form in which the driven portion is attached to the tip of the slider, and in which the driven portion is driven by merely causing the driven portion to move to and fro with the use of the slider, may be adopted.

While the invention has been described with reference to example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. A pressure-operated mechanism comprising:

a pressure chamber;

an operation portion that drives a driven portion or controls a controlled portion, according to a change in pressure in the pressure chamber;

a connection passage, at least part of which is attachable and detachable to and from the pressure chamber;

a disconnection detecting portion for detecting disconnection of the connection passage from the pressure chamber, based on a change in a condition of flow in the connection passage;

a pressure path, one end of which is connected to the pressure chamber, the other end of which is branched and respectively connected to a first pressure area and a second pressure area in which pressure is lower than the pressure in the first pressure area, the pressure path including the connection passage, wherein the disconnection detecting portion is connected to the pressure path, and a passage cross section of a section of the pressure path between a detachable portion of the connection passage and a connection portion of the disconnection detecting portion has a predetermined size such that detection of disconnection by the disconnection detecting portion is possible;

a switching portion, provided on the pressure path, for changing a state of communication between the pressure chamber and the pressure areas in order to cause a change in pressure in the pressure chamber; and a pressure transmission-reducing portion, provided on the pressure path, for preventing pressure in the pressure chamber from rapidly changing when the switching portion is switched, wherein:

the switching portion is configured to be selectively switched between a state in which the switching portion causes the pressure chamber to communicate with the first pressure area and a state in which the switching portion causes the pressure chamber to communicate with the second pressure area; and the pressure transmission-reducing portion includes a throat portion, of which a passage cross section is smaller than the predetermined size, on the pressure path.

2. The pressure-operated mechanism according to claim 1, wherein the pressure transmission-reducing portion is positioned on the pressure chamber side of the detachable portion of the connection passage on the pressure path.

3. The pressure-operated mechanism according to claim 2, wherein:

the pressure path includes a pressure pipe fixed to the pressure chamber, and the connection passage attachable and detachable to and from the pressure pipe; and the throat portion is provided in the pressure pipe.

4. The pressure-operated mechanism according to claim 3, wherein the throat portion is formed integrally with the pressure pipe.

5. The pressure-operated mechanism according to claim 1, wherein:

the switching portion is configured to be switched stepwise between the state in which the switching portion causes the pressure chamber to communicate with the first pressure area and the state in which the switching portion causes the pressure chamber to communicate with the second pressure chamber; and the pressure transmission-reducing portion includes the switching portion.

6. The pressure-operated mechanism according to claim 1, wherein:

the switching portion is configured to be able to maintain a state in which the switching portion causes the pressure chamber to communicate with both of the first pressure area and the second pressure area; and the pressure transmission-reducing portion includes the switching portion.

7. The pressure-operated mechanism according to claim 1, wherein:

the switching portion is configured to be switched steplessly between the state in which the switching portion causes the pressure chamber to communicate with the first pressure area and the state in which the switching portion causes the pressure chamber to communicate with the second pressure chamber; and the pressure transmission-reducing portion includes the switching portion.

8. The pressure-operated mechanism according to claim 1, wherein:

the first pressure area is an atmospheric pressure area; and the second pressure area is a negative pressure area in an internal combustion engine, in which area negative pressure occurs when the internal combustion engine is in operation.

9. The pressure-operated mechanism according to claim 1, wherein:

the operation portion includes a housing and a slider disposed in the housing;

the pressure chamber is defined by the housing and the slider in the housing; and the driven portion is driven according to a to-and-fro movement of the slider caused by the change in pressure in the pressure chamber.

10. A water pump comprising the pressure-operated mechanism according to claim 9, wherein:

the driven portion includes a rotor provided with a vane for circulating cooling water through an internal combustion engine and a radiator;

the slider is configured to be rotated by a driving force generated by the internal combustion engine; and each of the slider and the rotor is provided with a magnetic portion, wherein an amount of overlap in an axial direction varies due to the to-and-fro movement of the slider.

* * * * *